US005091616A

United States Patent [19]

Ramos et al.

[11] Patent Number: 5,091,616

[45] Date of Patent: Feb. 25, 1992

[54] SELF-CONTAINED SWITCH FOR ELECTRICAL DISTRIBUTION CIRCUIT

[75] Inventors: Joel A. Ramos, Chicago; Leonard V. Chabala, Maywood; Edward J. Rogers, Chicago; Thomas J. Tobin, Northbrook, all of Ill.

[73] Assignee: S&C Electric Company, Chicago, Ill.

[21] Appl. No.: 487,356

[22] Filed: Mar. 1, 1990

Related U.S. Application Data

[63] Continuation-in-part of Ser. No. 331,216, Mar. 30, 1989, Pat. No. 4,983,792, and a continuation-in-part of Ser. No. 331,311, Mar. 30, 1989.

[51] Int. Cl.[5] ..... H01H 33/02

[52] U.S. Cl. ..... 200/146 R; 200/48 R; 200/148 F

[58] Field of Search ..... 200/145, 148 R, 148 A, 200/148 B, 148 273 1, 48 A, 485 B, 144 R, 146 R, 49, 146 A; 361/331, 333, 335

[56] References Cited

U.S. PATENT DOCUMENTS

| | | | |
|---|---|---|---|
| Re. 27,625 | 4/1973 | Weston | 200/485 B |
| 2,529,145 | 11/1950 | Fernier | 200/148 F |
| 2,658,976 | 11/1953 | Hoye | 200/145 |
| 4,049,936 | 9/1977 | Frink et al. | 200/146 R |
| 4,202,591 | 5/1980 | Borgstrom | 200/144 C X |
| 4,293,834 | 10/1981 | Date et al. | 335/76 |
| 4,596,906 | 6/1986 | Chabala et al. | 200/48 R |
| 4,752,859 | 6/1988 | Chabala et al. | 361/333 |
| 4,788,392 | 11/1988 | Asai | 200/148 R |
| 4,983,792 | 1/1991 | Rogers et al. | 200/148 F |

OTHER PUBLICATIONS

McGraw Edison Bulletin 81046 (9/81).
Joslyn Publication D. B. 750-502 (1/84).
Joslyn Publication "SF6 Puffer Pak ® Switches", 1989.
Togami Electric Publication GE/K-0073a.

*Primary Examiner*—J. R. Scott
*Attorney, Agent, or Firm*—James V. Lapacek

[57] ABSTRACT

A multi-pole group-operated switch is provided for electrical power distribution circuits. The switch is self-contained and suited for ease of use with various line spacings and arrangements of the distribution lines; e.g., side-by-side (horizontal plane), phase-over-phase, and cable drops. The switch includes a plurality of switch-pole units carried at desired spacings by a base support and drive arrangement. Each of the switch-pole units includes a housing, interrupting contacts, and disconnect contacts. The housing that encloses the interrupting contacts in movable to perform the disconnect function. The base support and drive arrangement encloses a high-speed interrupting linkage for operation of the interrupting contacts of each of the switch-pole units and carries an operating mechanism that is connected to the interrupting linkage internal to a base support member of the base support and drive arrangement. The switch also includes a disconnect linkage to move the switch-pole housings. For manual operation of the disconnect function, an operating handle is provided. The operating handle and the operating mechanism are oriented and positioned relative to the switch in various predetermined locations that are desirable for the particular mounting configuration of the switch with respect to the line layout and the equipment pole. In a preferred embodiment, the switch includes integral dead-ending connection provisions and also includes integral line- parameter sensing and power-supply provisions incorporated within one or more of the switch-pole units.

51 Claims, 7 Drawing Sheets

SELF-CONTAINED SWITCH FOR ELECTRICAL DISTRIBUTION CIRCUIT

CROSS REFERENCE TO RELATED APPLICATION

This application is a continuation-in-part application of co-pending application Ser. Nos. 07/331,216 (now U.S. Pat. No. 4,983,792) and 07/331,311 filed on Mar. 30, 1989, in the names of Rogers et al and Tobin et al, respectively; application Ser. No. 07/331,216 being incorporated by reference herein for all purposes.

BACKGROUND OF THE INVENTION

1. Field of the Invention

The present invention relates generally to the field of electrical switches and circuit interrupters, and more particularly to a multi-pole group-operated switch that is self-contained, includes dead-ending features, provides a circuit-interrupter function and selective disconnect feature via movement of an interrupter housing that functions as a movable switch member, and is capable of a number of mounting configurations that are desirable and suited to the line layouts of electric power distribution circuits.

2. Description of the Related Art

Automated electrical power distribution systems provide a number of desirable features such as improved load balancing, fault location, and sectionalizing. Control of these systems requires the sensing of various circuit parameters. For example, U.S. Pat. Nos. 4,351,994, 4,002,976. 4,700,123, and 4,823,022 are directed to devices and arrangements for sensing current and voltage present in electrical distribution circuits. However, available distribution switches do not provide a self-contained switch that is capable of a number of desirable mounting configurations and that is suited for integration with the electrical distribution lines. For example, the McGraw Edison F Switch, the Joslyn VBM (configured as a reclosing sectionalizer), the Joslyn Puffer Pac overhead $SF_6$ switch, and the A.B. Chance $SF_6$ recloser are not self-contained switches and are not suited for the typical line-spacings of electrical power distribution systems. Further, these arrangements do not provide selective disconnect functions to establish a visible air gap after the interrupters have been opened. While the Alduti-Rupter Switch and the Omni-Rupter Switch, both available from S&C Electric, do provide a number of advantages relating to mounting configurations that are suitable to typical line spacings, these switches require separate circuit-parameter sensing devices and thus are not totally self-contained in that all the component parts such as the sensing devices, operator, battery, etc., are not carried with the switch.

Various other types of switches and circuit interrupters are known as illustrated, for example, by U.S. Pat. Nos. Re. 27,625; 2,658,976; 4,596,906; and 4,752,859. In U.S. Pat. No. Re. 27,625, initial rotation of a shaft within an insulator opens interrupters in a T-shaped interrupter/disconnect structure supported by the insulator with continued rotation of the shaft rotating the insulator to open the disconnect. In U.S. Pat. 2,658,976, rotation of a shaft within an insulator opens an interrupter rotatably supported atop the insulator with continued rotation of the shaft causing rotation of the interrupter housing to perform a disconnect function. U.S. Pat. 4,752,859 is directed to a variety of multi-pole switch configurations which utilize a high-speed base drive linkage that translates an operating member within an insulator to operate an interrupter with the insulator being rotated via a separate disconnect linkage to operate a disconnect. However, these arrangements are also not suitable to provide a self-contained switch for use in automated distribution systems.

SUMMARY OF THE INVENTION

Accordingly, it is a principal object of the present invention to provide a self-contained multi-pole group-operated switch configuration for electrical power distribution circuits that is capable of a number of desirable mounting configurations suited for integration with the line layouts of electrical distribution lines and that includes a selective disconnect function to establish a visible air gap after circuit interruption; the selective disconnect function being provided via movement of an interrupter housing that functions as a movable switch member.

It is another object of the present invention to provide a self-contained switch configuration including dead-ending capabilities that permit the replacement of various switch components while maintaining the dead-ending function.

It is a further object of the present invention to provide a switch including a plurality of switch-pole units carried by a base support member at suitable spacings, separate disconnect and high-speed interrupter linkages, and an operator mechanism supported on the base support member; one or more of the switch-pole units including integral circuit-parameter sensing arrangements having signal conductors enclosed by the switch-pole units —the base support member enclosing the high-speed interrupter linkage and the signal conductors connected to the switch-pole units.

It is yet another object of the present invention to provide a multi-pole switch suited for integration with electrical power distribution lines and including a plurality of switch-pole units which have an interrupter housing that is movable as a switch member to serve a disconnect function, a base support and drive arrangement which carries the switch-pole units and which encloses a high-speed interrupting linkage and a separate disconnect linkage for movement of the interrupter housing to selectively perform the disconnect function.

These and other objects of the present invention are efficiently achieved by a multi-pole group-operated switch for electrical power distribution circuits that is self-contained and suited for ease of use with various line spacings and arrangements of the distribution lines, e.g., side-by-side (horizontal plane), phase-over-phase, and cable drops. The switch includes a plurality of switch-pole units carried at desired spacings by a base support and drive arrangement. Each of the switch-pole units includes a housing, interrupting contacts, and disconnect contacts. The housing that encloses the interrupting contacts is movable to perform the disconnect function. The base support and drive arrangement encloses a high-speed interrupting linkage for operation of the interrupting contacts of each of the switch-pole units and carries an operating mechanism that is connected to the interrupting linkage internally to a base support member of the base support and drive arrangement. The switch also includes a disconnect linkage to move the switch-pole housings. For manual operation of the disconnect function, an operating handle is provided.

The operating handle and the operating mechanism are oriented and positioned relative to the switch in various predetermined locations that are desirable for the particular mounting configuration of the switch with respect to the line layout and the equipment pole.

In a preferred embodiment, the switch includes integral dead-ending provisions. The switch-pole units are supported on a first support member, while the dead-ending provisions are provided on a second support member. The first and second support members are both carried by a mounting bracket for attachment to an equipment pole. In this manner, replacement of one or more of the switch-pole units can be performed while maintaining the dead-ending function. Further, dead-ending loads are not transmitted to either the first support member or the switch-pole units. Integral line-parameter sensing and power-supply provisions are also incorporated within one or more of the switch-pole units.

BRIEF DESCRIPTION OF THE DRAWING

The invention, both as to its organization and method of operation, together with further objects and advantages thereof, will best be understood by reference to the specification taken in conjunction with the accompanying drawing in which like reference characters refer to like elements and in which:

FIGS. 9–12 are elevational views of various mounting configurations of the switch of FIGS. 1–8 wherein FIG. 9 illustrates an upright configuration as shown in FIGS. 1, 5 and 6, FIG. 10 illustrates a vertical configuration, FIG. 11 illustrates a tiered-outboard configuration, and FIG. 12 illustrates a pole-top configuration.

DETAILED DESCRIPTION

Figures 1, 2:
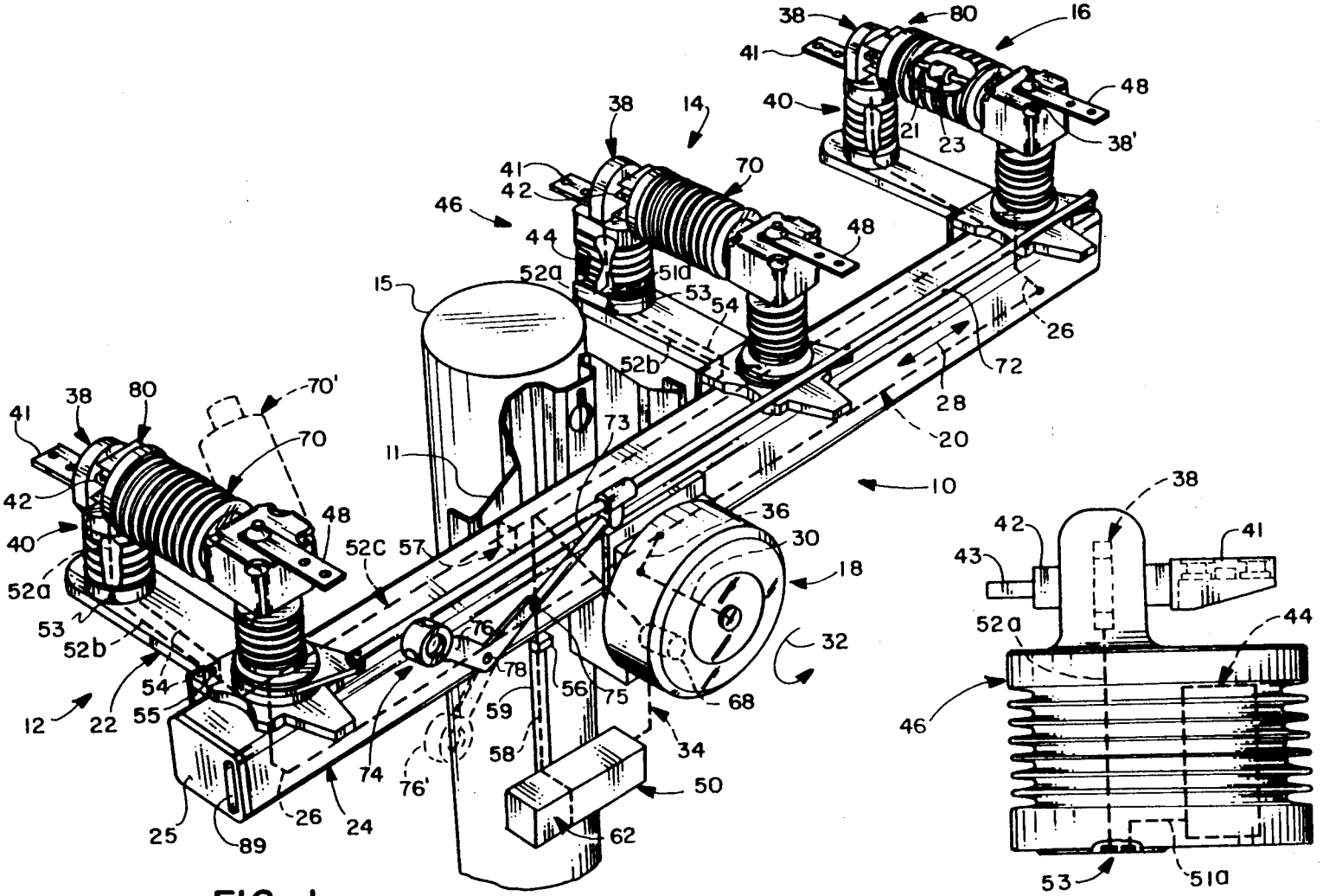
FIG. 1 is a perspective view of a self-contained multi-pole group-operated switch according to the present invention.
FIG. 2 is an elevational view of an integral circuit-parameter sensing arrangement for use with the switch of FIG. 1.

Referring now to FIG. 1, a multi-pole group-operated switch 10 according to the present invention is illustrated for use in electrical power distribution circuits. The illustrative switch configuration 10 of FIG. 1 utilizes three switch-pole units 12, 14 and 16. For example and not to be interpreted in any limiting sense, the switch-pole units 12, 14 and 16 are generally of the type illustrated in co-pending application Ser. No. 07/331,216, now U.S. Pat. No. 4,983,792. The switch configuration 10 also includes an operating mechanism 18 which operates a drive train generally referred to at 20 that is coupled to operate each of the switch-pole units 12, 14 and 16. The switch-pole units 12, 14 and 16 include various circuit-parameter sensing and power-supply arrangements integral to the switch-pole units 12, 14, and 16. These integral arrangements provide appropriate information to determine when the switch 10 is to be operated to open the circuit path established by each of the switch-pole units 12, 14, and 16. Additionally, these integral arrangements also provide operating power to the operating mechanism 18. While the switch configuration 10 will be used as an illustrative example to describe the present invention, it should be realized that the present invention is useful in conjunction with various switch configurations having various combinations of mounting patterns, spacing, and orientations, as well as various switch-pole units having diverse circuit-interrupting and/or disconnect contacts. For example, see the switch configurations of FIGS. 9–12 which will be discussed in more detail hereinafter.

Figure 3:
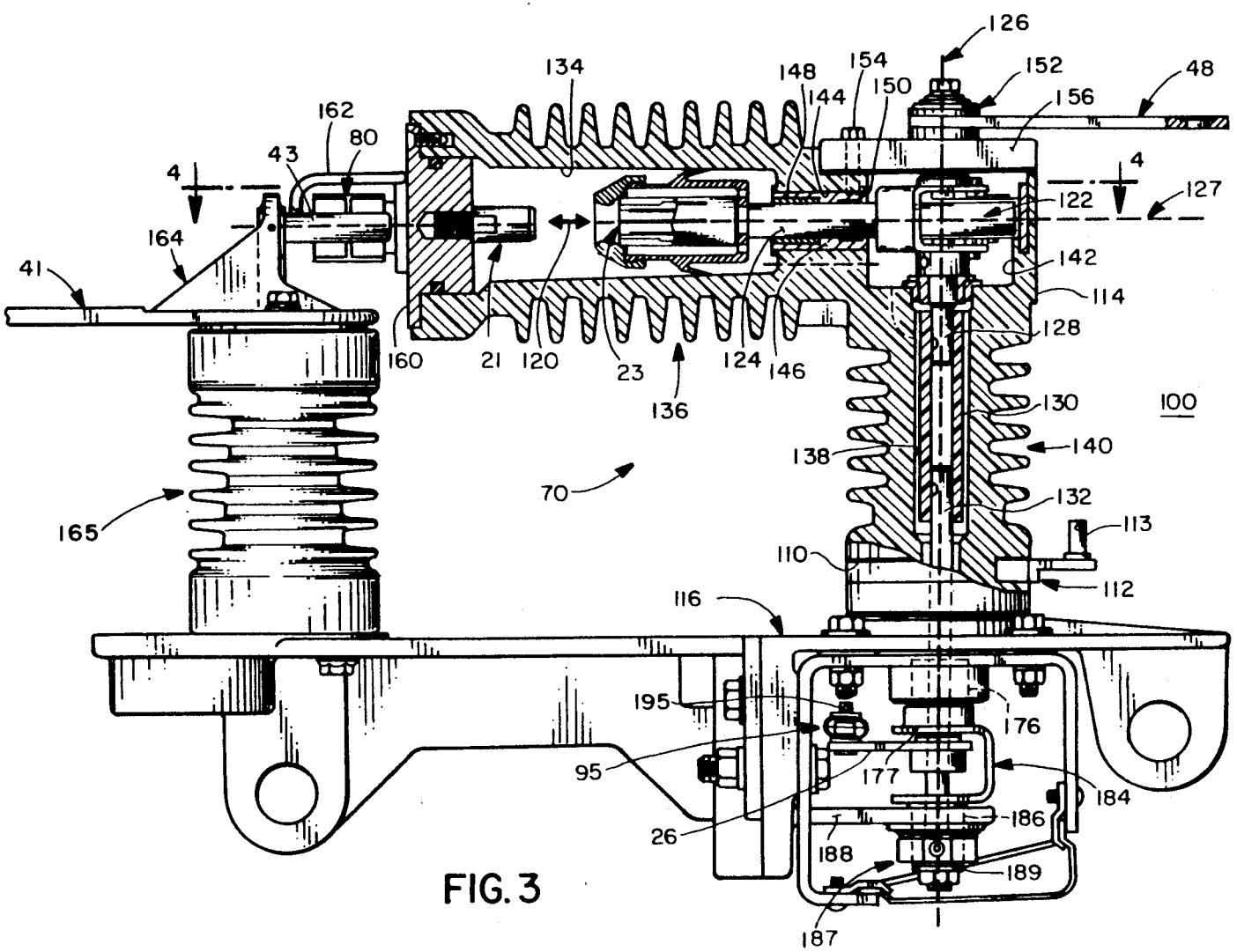
FIG. 3 is an elevational view, partly in section and with parts cut away for clarity, of a switch-pole unit of the switch of FIG. 1.
Figure 5:
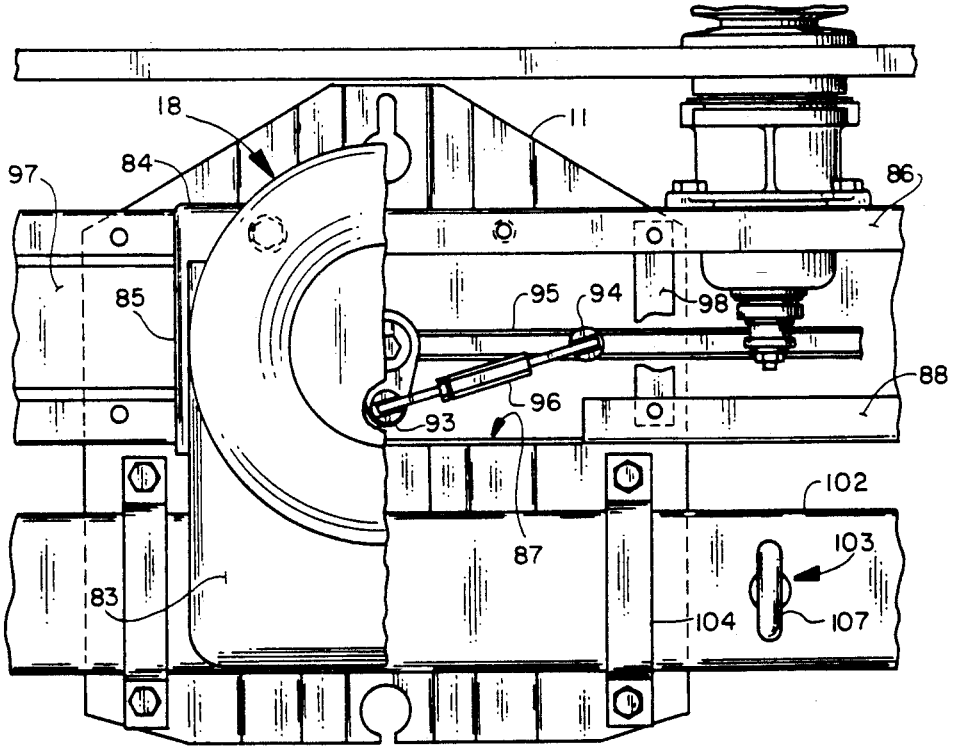
FIG. 5 is a front elevational view, with parts cut away for clarity, of a portion of a preferred embodiment of the switch of FIG. 1 including dead-ending arrangements.
Figure 6:
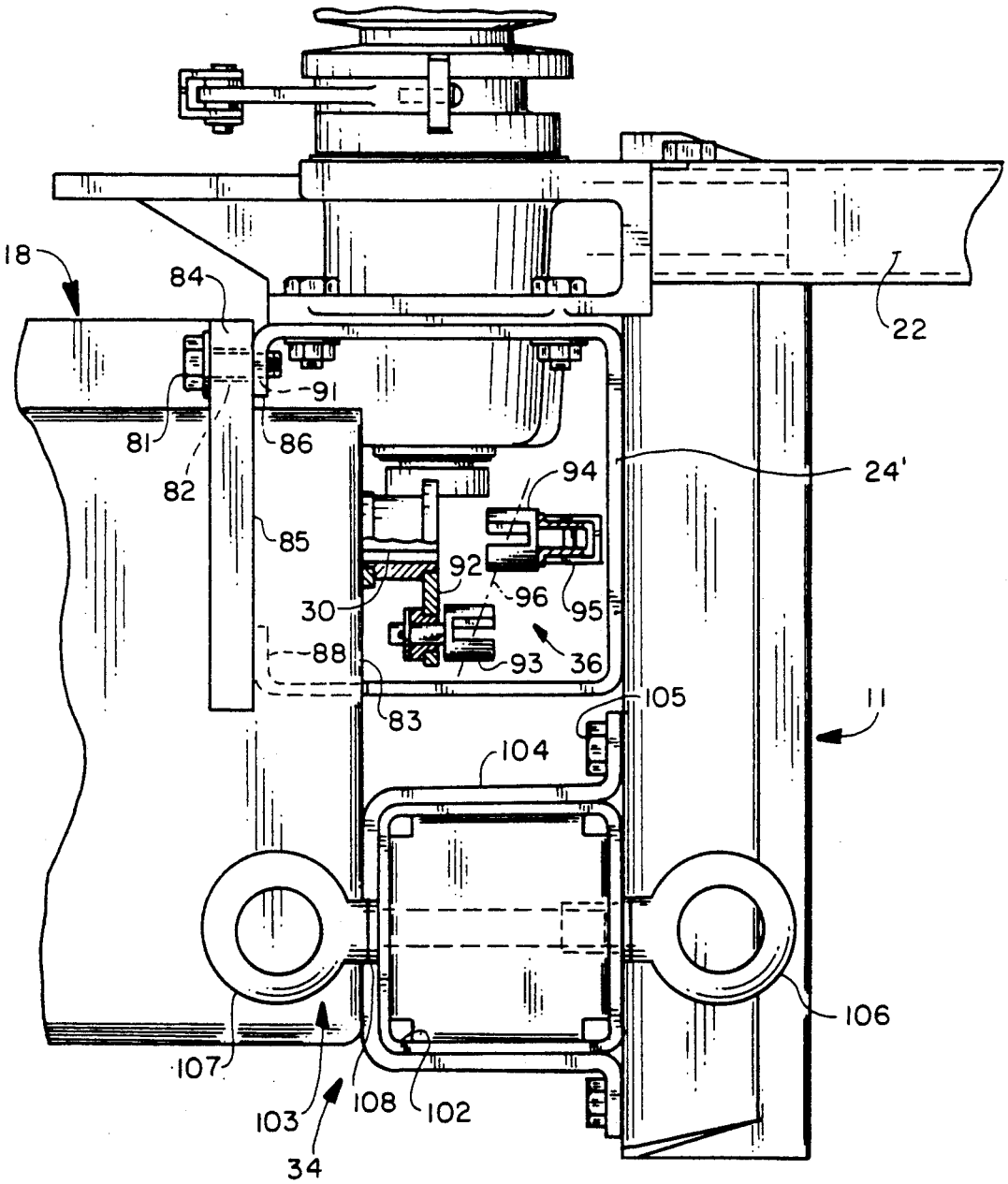
FIG. 6 is a right-side elevational view, partly in section for clarity, of FIG. 5.

In any case, considering the specific illustrative embodiment of FIG. 1, a support base 22 of each of the switch-pole units 12, 14, and 16 is affixed to a tubular support member 24 via suitable fasteners (shown in FIG. 3). The tubular support member 24 is closed at either end by end caps 25. The tubular support member 24 is affixed to a mounting bracket 11 (as shown in FIG. 5) which in turn is affixed to an equipment pole 15.

An operating lever arm 26 of each of the switch-pole units 12, 14, and 16 is connected to a drive train referred to generally at 20. For example, as illustrated by the bi-directional arrows 28, movement of the drive train 20 to the right opens a pair of separable interrupting contacts 21,23 of each of the switch-pole units 12, 14 and 16, and movement to the left closes the separable interrupting contacts. The drive train 20 is operated at high speeds by the operating mechanism 18. The operating mechanism 18 is of the type which rapidly rotates an output shaft generally referred to at 30, for example, in a direction 32 to selectively open or close the interrupting contacts of the switch-pole units 12, 14, and 16. This type of operating mechanism 18 is often referred to as having "quick-make quick-break" capability in that the drive train 20 may be rapidly sequenced to the left, then to the right. The operating mechanism 18 receives control information at 34 to determine when the shaft at 30 is to be rotated to open or close the switch-pole units 12. 14, and 16. Operating mechanisms of this type commonly use one or more springs to store energy; the spring or springs being charged via an electric motor or the like. In any case, the rotation in the direction 32 is translated via the interconnection linkage at 36 into movement either to the right or to the left by the drive train 20. For example, if the switch-ploe units 12, 14, and 16 are in the closed position, rotation of the drive shaft 30 will open the separable interrupting contacts 21,23 in each of the switch-pole units 12, 14, and 16 by movement of the drive train 20 to the right. Subsequent rotation of the drive shaft 30 results in closing of the interrupter contacts 21,23 via movement of the drive train 20 to the left.

The drive train 20 is enclosed within the tubular support member 24. The output shaft 30 extends into the tubular support member 24 such that the interconnection linkage 36 is also internal to the tubular support member 24. Thus, the tubular support member 24 and the drive train 20 may be referred to as a base support and drive arrangement or a high-speed base drive.

Each of the switch-pole units 12,16 includes a support insulator 40 having integrally incorporated therewith an integral current-sensing device generally referred to at 38 and a circuit terminal conductor 42. The circuit terminal conductor 42 also includes an affixed first circuit terminal 41 to define a first terminal. The switch-pole unit 14 includes an integral current-sensing device 38 and an integral voltage-sensing device 44 (also referred to as a potential device) which are integrally incorporated within a support insulator 46 along with a circuit terminal conductor 42. Each of the support insulators 40 and 46 with integral circuit-parameter sensing devices can also be referred to as a composite of an insulative support, circuit parameter devices and a circuit terminal arrangement.

Referring now additionally to FIG. 2, in a preferred arrangement, the current-sensing device 38 is integrally incorporated about the circuit terminal conductor 42 during a molding process wherein the circuit terminal conductor 42, the current-sensing device 38, the voltage-sensing device 44, and signal conductors 51*a* and 52*a* are integrally incorporated into the support insulator 46. The signal conductors 51*a* and 52*a* connect the outputs of the voltage-sensing device 44 and the current-sensing device 38, respectively, to the lower end of the support insulator 46 at output terminals 53. The support insulator 46 of FIG. 2 illustrates one particular design as disclosed and claimed in co-pending application Ser. Nos. 07/331,311 and 07/331/570. In the preferred embodiment, the support insulators 40 and 46 are molded from a cycloaliphatic resin.

A respective second circuit terminal 48 is also provided on each of the switch-pole units 12, 14, and 16; the circuit path of each pole or phase of the switch configuration 10 being defined between the first and second circuit terminals 41,48 and including the separable interrupting contacts 21,23 carried by each of the switch-pole units 12, 14 and 16. Each of the circuit terminals 41,48 is respectively connected to one of the separable interrupting contacts 21,23.

Current-sensing information from each of the current-sensing devices 38 is communicated to an RTU (remote terminal unit) 50 via conductors referred to generally at 52. Specifically, signal conductors 52*a* communicate through the support insulators 40,46 and exit the insulators at the terminals 53. Additionally, signal conductors 52*b* communicate from the terminals 53 through a conduit or passage 54 that extends along each support base 22 and into the support member 24. In a specific embodiment, terminals or electrical connectors 55 are provided at the interface of the support member 24 and the support base 22. Conductors 52*c* communicate within and along the support member 24 from the terminals 55 to a connector at 56 for connection to the RTU 50; the conductors 52*c* passing through a conduit, passage, or like guiding arrangement 57 provided within the support member 24.

Signal conductors 58 within a conduit 59 connect the circuit-parameter sensing signals from the connector 56 to the RTU 50. In this manner, mechanical and electrical shielding of the signal conductors 52 is provided. The signal conductors 52*c* are also connected to supply operating power to a motor 68 of the operating mechanism 18. The signals present on the signal conductors 52*c* are connected to the RTU 50 to provide sensed voltage information of the voltage at the first terminal 41 of the switch-pole unit 14, to provide charging of a battery 62 contained within the RTU 50, and to provide sensed current information of the current passing through each of the circuit terminal conductors 42 of each of the switch-pole units 12, 14 and 16.

The RTU 50 communicates the sensed current and voltage information to a substation or the like via a communication link; e.g., radio. The RTU 50 also receives information from a substation via the communication link to provide operating control signals on conductors 34, for example, to control the operator 18 to rotate the shaft 30 when switch operation is desired. In one specific arrangement, the sensed circuit-parameter signals on the conductors 52*c* are utilized to provide control of the operating mechanism 18 for switch operation.

In the specific switch configuration 10, each switch-pole unit 12, 14, and 16 includes separable interrupting contacts 21,23 within an interrupter 70; the separable interrupting contacts 21,23 being operable via the drive train 20. Additionally, each of the interrupters 70 is rotatably mounted with respect to the support base 22 so as to be movable to the position 70' to provide a disconnect function as explained in more detail hereinafter., i.e., the interrupter 70 functioning as a movable switch member. Each of the interrupters 70 includes a housing fabricated from insulating material.

Specifically, a disconnect drive link 72 is driven by a disconnect control generally referred at 74. The disconnect control 74 is operated via a hookstick or the like —although, of course, in other embodiments, it could define a motor-driven output or a linkage for remote manual operation. The disconnect control 74 includes a crank arm or handle 76 that is pivotally supported at 78 by the tubular support member 24. The disconnect control 74 is coupled to the drive link 72 via a link member 73 that is pivotally coupled to the drive link 72 and to the crank arm 76 at 75. Movement of the handle 76 provides corresponding movement of the drive link 72 to rotate the interrupter 70 of each of the switch-pole units 12, 14, and 16. Accordingly, if the interrupter switch-pole units 12, 14 or 16 are each in the closed position as shown, the handle 76 will be in the position as shown. When a visible air gap (circuit isolation) is desired, the handle 76 is moved downward to the left to the phantom position 76' and the interrupters 70 are rotated to the phantom position 70' such that a jaw contact 80 carried by the interrupter 70 is disconnected and physically separated from a stationary contact 43 (FIG. 2) carried by the circuit terminal conductor 42. Correspondingly, movement of the handle 76 back to the position as shown results in the connection of the jaw contact 80 to the conductor 42.

The interrupter 70 and the support insulator 40 or 46 provide suitable insulation between the first and second circuit terminals 41,48 and also with respect to the support base 22.

In one specific alternate arrangement, a current-sensing device 38' is integrally incorporated with the interrupter 70 so as to sense current flowing between the first and second circuit terminals 41 and 48. In another specific arrangement, a voltage-sensing device 44 is provided with either the insulator 46 or the interrupter 70 —with or without a current-sensing device. In yet another specific arrangement, the current-sensing device 38 is positioned adjacent the terminal conductor 42 rather than around the terminal conductor 42. Additionally, each switch-pole can include any combination of circuit-parameter sensing devices (or no circuit-parameter sensing devices such as illustrated in FIG. 3), such as an integral current-sensing device one or more integral voltage-sensing devices, or an integral combination voltage and current-sensing device such as shown in FIG. 2.

Figure 4:
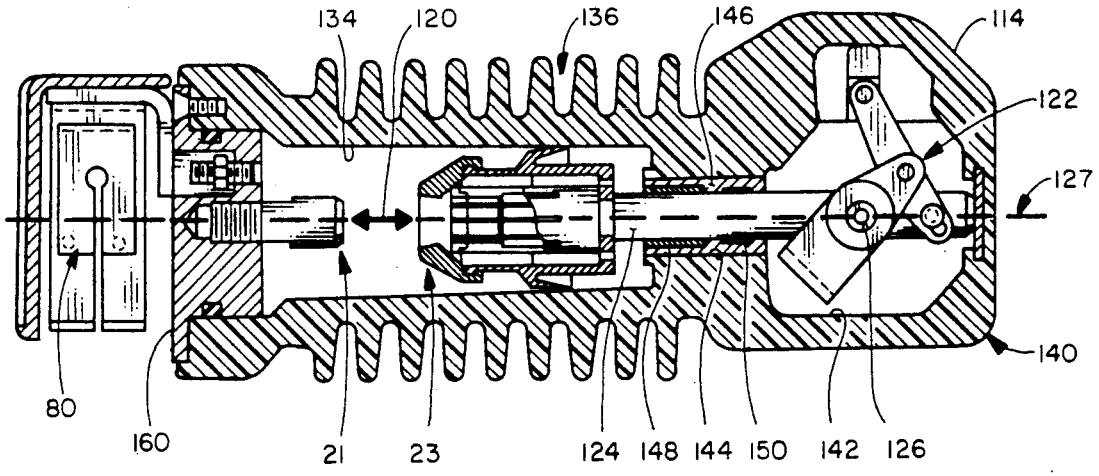
FIG. 4 is a sectional view of the switch-pole unit of FIG. 3 taken generally along the line 4—4 of FIG. 3.

Referring now to FIGS. 3 and 4, a switch-pole unit 100 similar to the switch-pole units 12, 14, and 16 will be described in more detail; the switch-pole unit 100 being identical to the switch-pole units 12, 14, and 16 except that no parameter-sensing devices 38 or 44 are incorporated into the support insulator 165 of FIGS. 3 and 4. The interrupter 70 includes a housing 114 that is integrally formed of insulating material and that carries and houses the separable interrupting contacts including the movable contact 23 and the stationary contact 21. The movable contact 23 is movable along the path of bi-directional arrows 120 along an axis 127 via an operating linkage generally referred to at 122. The operating linkage 122 is connected to the movable contact 23 via a contact rod 124 which is electrically conductive. The operating linkage 122 translates rotary motion about an axis 126 into translational motion along the path of the bi-directional arrows 120. Rotation about the axis 126 is provided via an input shaft 128 which is coupled via an insulative tube 130 to an operating member 132. It should be noted that the axis 126 of the operating member 132 and the axis 127 of the separable interrupting contacts 21,23 are aligned or coplanar so as to achieve efficiency of the molding of the interrupter housing 114.

The integrally formed interrupter housing 114 defines a first portion 140 and a second portion 136 extending from said first portion 140 and at a predetermined angle thereto; e.g. generally perpendicular in the specific embodiment of FIG. 1. For clarity of description, the first portion 140 will be referred to hereinafter as the vertical portion 140, although it should be understood that in particular mounting configurations the portions of the interrupter housing 140 may assume any orientation, including a horizontal orientation of the first portion 140. Similarly, the second portion 136 will be referred to hereinafter as the horizontal portion 136 for clarity. The interrupter housing 114 also includes: a first defined cavity or passageway 134 in the horizontal portion 136; a second defined passageway 138 which runs throughout the length of the vertical portion 140 in which the shaft 128, the operating member 132, and the tube 130 are disposed; and a third defined cavity 142 at the intersection of the horizontal portion 136 and the vertical portion 140 for housing the operating linkage 122. A bore 144 communicates between the first defined cavity 134 and the third defined cavity 142. As seen in FIG. 4, a tubular conductive sleeve 146 is positioned within the bore 144 and carries a bearing 148 and a contact sleeve 150 which cooperate with the shaft 124. The contact sleeve 150 is preferably fabricated to define multiple contact laminations. The conductive sleeve 146 is electrically connected to a swivel contact generally referred to at 152 via a suitable electrically conductive path. For example, as illustrated in FIGS. 3 and 4, the electrically conductive path is provided by a screw 154 that passes through a conductive cover plate 156 and contacts the conductive sleeve 146. The second circuit terminal 48 is connected to the swivel contact 152.

Figure 7:
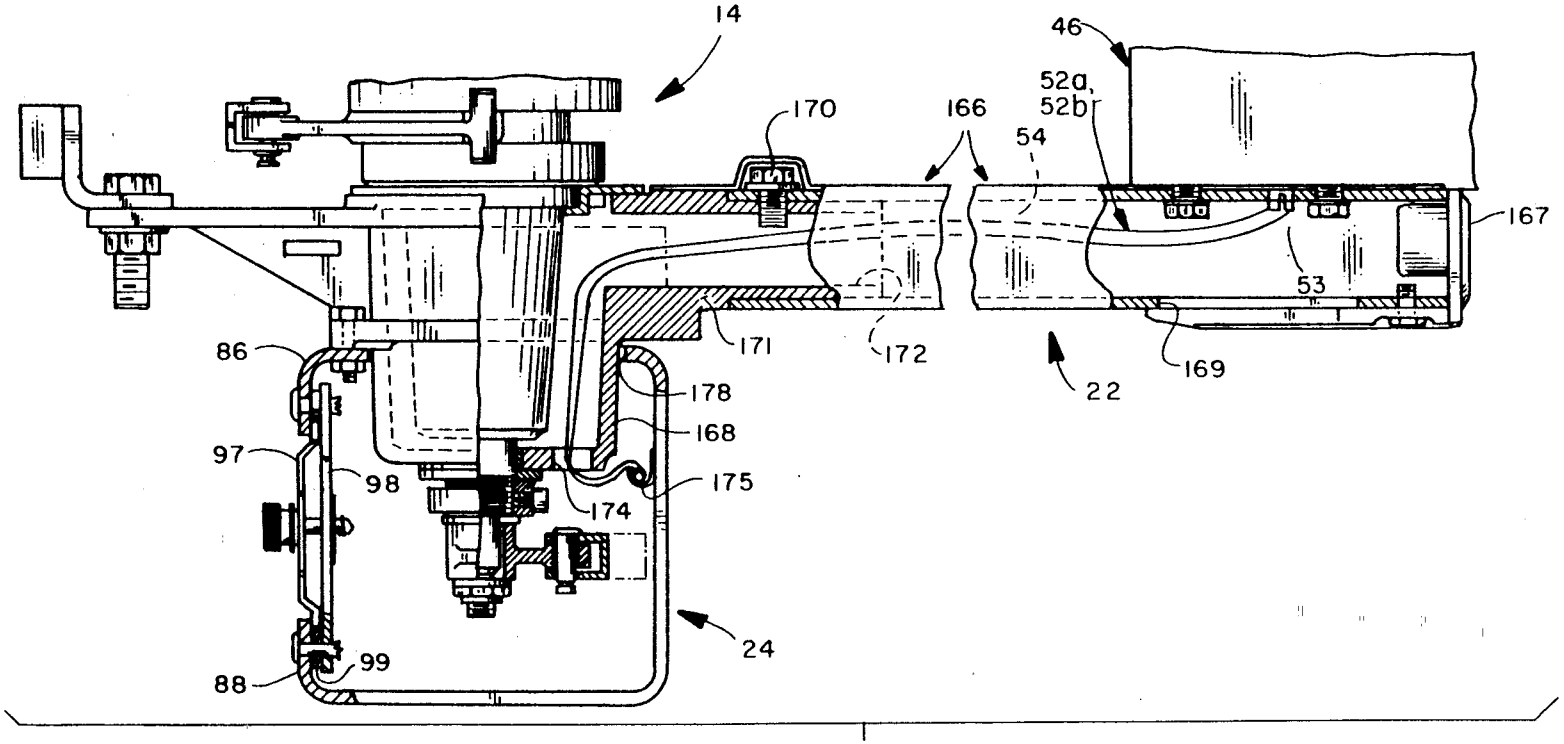
FIG. 7 is an elevational view, partly in section, of a switch-pole unit and a tubular support member of the switch of FIG. 5.
Figure 8:
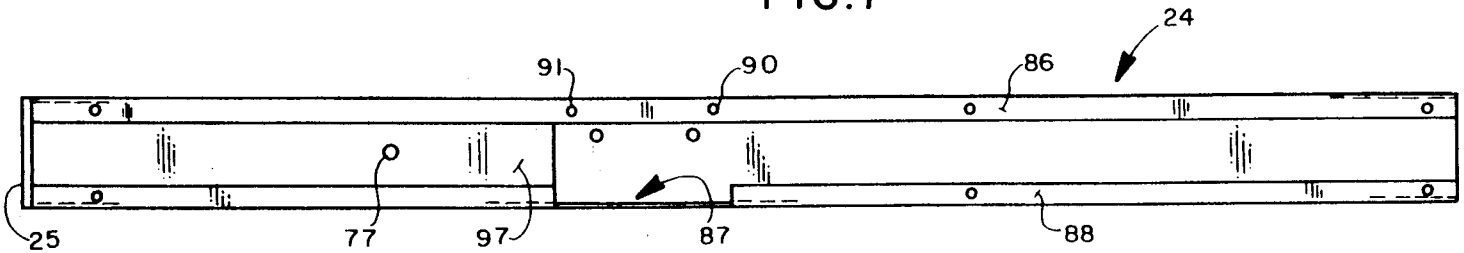
FIG. 8 is a front elevational view of the tubular support member of FIG. 5.

The stationary interrupting contact 21 is carried by an end plate 160 which closes the cavity 134. The stationary interrupting contact 21 is electrically connected to the jaw contact 80., e.g. in FIGS. 3 and 4, the jaw contact 80 is carried by the end plate 160 which is conductive. The terminal arrangement 164 is affixed to the support insulator 165 that is in turn affixed to a support base 116 that is a simplified version of the support base 22 of FIG. 1, which will be discussed in more detail hereinafter in connection with FIG. 7. The terminal arrangement 164 includes the first circuit terminal 41. In specific embodiments, the support insulator 165 is a circuit-parameter sensing arrangement as disclosed in FIG. 2 and discussed hereinbefore.

Considering operation of the switch-pole unit 100, upon appropriate rotation of the operating member 132, the contacts 21,23 are separable and engageable to perform respective circuit connection and circuit interruption functions of the circuit path from the first circuit terminal 41 to the second circuit terminal 48 defined at the swivel or hinge contact 152. The interrupter switch 100 is thus operable via rotation of the operating member 132 in the counterclockwise direction in FIG. 4 to close the contacts 21,23 completing a circuit between the circuit terminals 41,48. Rotation of the operating member 132 in the clockwise direction will open the contacts 21,23, interrupting the circuit between the terminals 41,48.

In accordance with important additional aspects of the present invention, the switch-pole unit 100 is also capable of providing visible circuit isolation subsequent to the circuit interruption that is obtained by the separation of the contacts 21,23. To this end, the interrupter housing 114 is rotatably mounted with respect to the support base 116. When it is desired to provide visible circuit isolation subsequent to circuit interruption, the housing 114 is rotated about the axis 126 so as to move the horizontal portion 136 a suitable distance for separation of the disconnect contacts 43,80 in accordance with the desired visible air break.

The interrupter housing 114 defines a circumferentially narrowed portion 110. An operating collar 112 is affixed about the portion 110 of the housing 114. The operating collar 112 includes a protruding pin 113. The housing 114 also includes an affixed C-shaped mounting member 184 with tubular portion 176 at the lower end of the vertical portion 140. Preferably, the tubular portion 176 is incorporated into the interrupter housing 114 during the molding process. The mounting member 184 includes a central bore 177. The operating member 132 extends through the bore 177 of the mounting member 176. The lower portion 186 of the mounting member 184 extends through a support member 188 that extends from the support base 22. The lower portion 186 of the mounting member 184 is threaded and a fastening collar assembly 187 with suitable threads is affixed to the mounting member 184.

The operating member 132 extends through the mounting member 184 and below the support member 188. The operating member 132 is threaded at the lower end thereof and receives a thrust washer 189 and a nut 191. The operating lever arm 26 is affixed to and extends from the operating member 132. A pin 195 protrudes from the operating lever arm 26. Accordingly, movement of the operating lever arm 26 about the axis 126 via the interrupter drive train 20 rotates the operating member 132.

Referring now to FIGS. 5–8, the operating mechanism 18 is attached to the tubular support member 24 via threaded fasteners 81 (FIG. 6) that pass through respective apertures 82 in a rear flange 84 of the operating mechanism 18. In the preferred embodiment, the tubular support member 24 is fabricated with a generally square cross-section to include three closed sides or walls having inwardly turned edges at the front to provide facing flanges 86, 88. The lower flange 88 is cut away to define a predetermined opening 87 for receiving the housing 83 of the operating mechanism 18 into the tubular support member 24. Threaded apertures 90, 91 (FIGS. 6 and 8) are provided in the upper flange 86 into which the fasteners 81 are threaded for supporting the operating mechanism 18 with respect to the tubular support member 24. The output shaft 30 of the operating mechanism 18 extends through the generally open front of the tubular support member 24 and into the interior thereof. A crank arm 92 is fixedly carried by the output shaft 30 for imparting movement to the interconnection linkage 36 of the base drive arrangement for operation of the interrupter contacts.

Specifically, the interconnection linkage 36 (FIGS. 5 and 6) includes a swivel pin 93 rotatably carried by the crank arm 92, a swivel pin 94 rotatably carried by the interrupter drive train 20 (specifically illustrated in FIGS. 5 and 6 by channel member 95 functioning as a drive arm or link), and an interconnecting link 96 (FIG. 5) attached between the swivel pins 93,94. The member 95 is connected to the operating lever arms 26 (FIG. 3) of the switch-pole units 12,14,16 of FIGS. 1–4. With the operating mechanism 18 affixed to the tubular support member 24 and the interconnector linkage 36 assembled to the interrupter drive train 20, face panels 97 (FIGS. 5 and 7) can be inserted from each side of the tubular support member 24 to close off the switch from the exterior. To this end, guides 98 are affixed between the flanges 86,88 of the tubular support member 24 along with appropriate spacers 99 to provide a guiding surface for insertion and appropriate retention of the face panels 97. Accordingly, for removal of the operating mechanism 18 from the switch, the right face panel 97 is moved to expose the interconnection linkage, the link 96 is disassembled from the swivel pin 94. When the fasteners 81 are removed, the operating mechanism 18 with link 96 can be easily removed from the tubular support member 24. Provisions are made for assembly of the disconnect handle 76 via an aperture 77 in the left-hand face panel 97. The flange 84 of the operating mechanism 18 extends at 85 (FIG. 5) around the side of the housing 83 so as to overlap the lower flange 88 of the tubular support member and cover the opening 87. The face panels 97 also are overlapped by the flange 85. Thus, the operating mechanism 18, the tubular support member 24, and the face panels 97 close off the switch 10 from the exterior. As shown in FIG. 1, the end cap 25 in a specific embodiment is provided with a slit or hole 89 for insertion/removal of the face panel 97 without the necessity of removing the end cap 25. It should also be realized that the face panels 97 may be carried by the tubular support member 24 other than by the face panels 97 and guides 98. Of course, it should be realized that in other embodiments, the predetermined opening in the tubular support member 24 through which the output shaft 30 extends may be defined other than by the face panels 97. For example, a closed-wall tubular support member can be utilized with a defined opening therein for receiving the output shaft 30. For assembly and disassembly of the operating mechanism 18, an access panel is provided over the area of 92,93.

In accordance with additional features of the present invention, dead-ending arrangements 34 are provided via a structural member 102 and attachment members 103 extending therefrom. The structural member 102 is affixed to the main mounting bracket 11; e.g., by clamps 104 and fasteners 105. The attachment member 103 includes a first attachment eye member 106 which is threadingly engaged with a second attachment eye member 107. The attachment member 103 is affixed to the structural member 102 via apertures 108 in opposed side walls of the structural member 102; each of the members 106,107 being positioned through one of the opposed side walls and threaded together. The location of the dead-ending arrangement 34 with respect to the tubular support member 24 and the positioning of the attachment member 103 along and about the structural member are selected in accordance with the line layout or design for which the overall switch configuration is intended.

For example, the dead-ending arrangement 34 may be utilized in the various mounting configurations of FIGS. 9–12. However, the dead-ending arrangement is not normally necessary for the vertical configuration of FIG. 10 suited to switching cable drops. Additionally, for the tiered-outboard configuration of FIG. 11, dead-ending could be provided on the equipment pole 15. It should be noted that while a specific illustrative embodiment of the dead-ending arrangement is shown, it should be realized that various other members 102 and 103 of diverse structures, shape, and assembly may also be utilized in the practice of the invention to achieve the dead-ending arrangement. For example, the cross section of the structural member 102 can be round or oval, and the structure of the member 103 can comprise two eye members and a threaded rod therebetween.

Thus, the dead-ending arrangement 34 is integral to the overall self-contained switch so as to permit removal of the switch-pole units or the entire tubular member 24 with the switch-pole units while maintaining the dead-ending function. That is, while the dead-ending arrangement 34 is supported with the overall switch configuration via the mounting bracket 11 so as to be integral with the switch configuration and match the spacings of the lines and the switch-pole units, the dead-ending arrangement 34 is separate to the extent of permitting removal of all portions of the switch other than the dead-ending arrangement 34 and the support bracket 11. Additionally, unlike arrangements which include dead-ending brackets on the switch-pole units, since the dead-ending arrangement 34 is separate from the tubular support member 24 and the switch-pole units 12, 14 and 16, the dead-ending loads are not transmitted to the remainder of the switch. Further, the implementation of the dead-ending arrangement 34 via the structural member 102 permits the addition or deletion of the dead-ending capability in a simplified manner.

Figure 9:
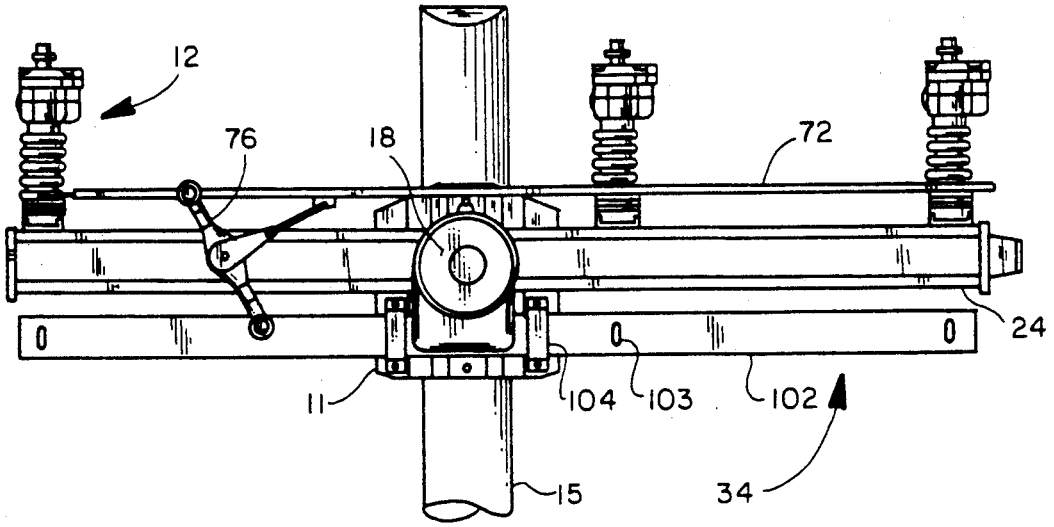
Figure 10:
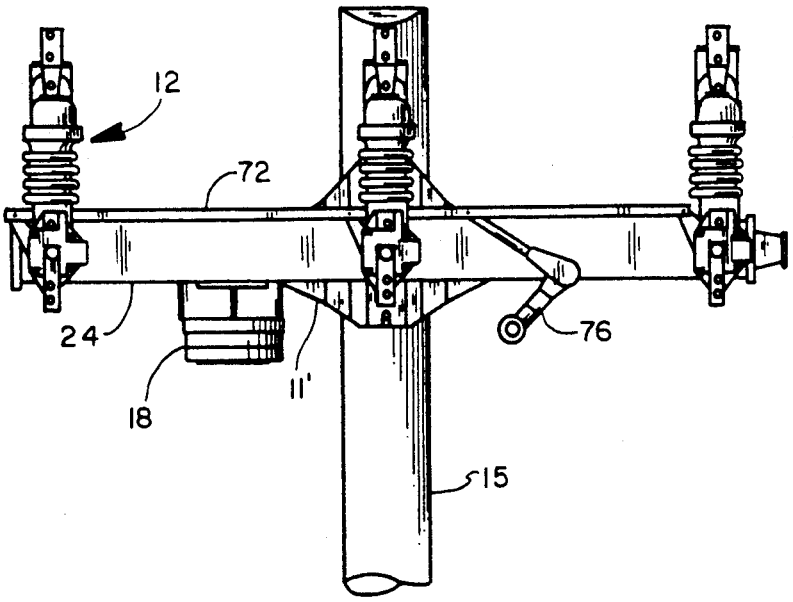
Figure 11:
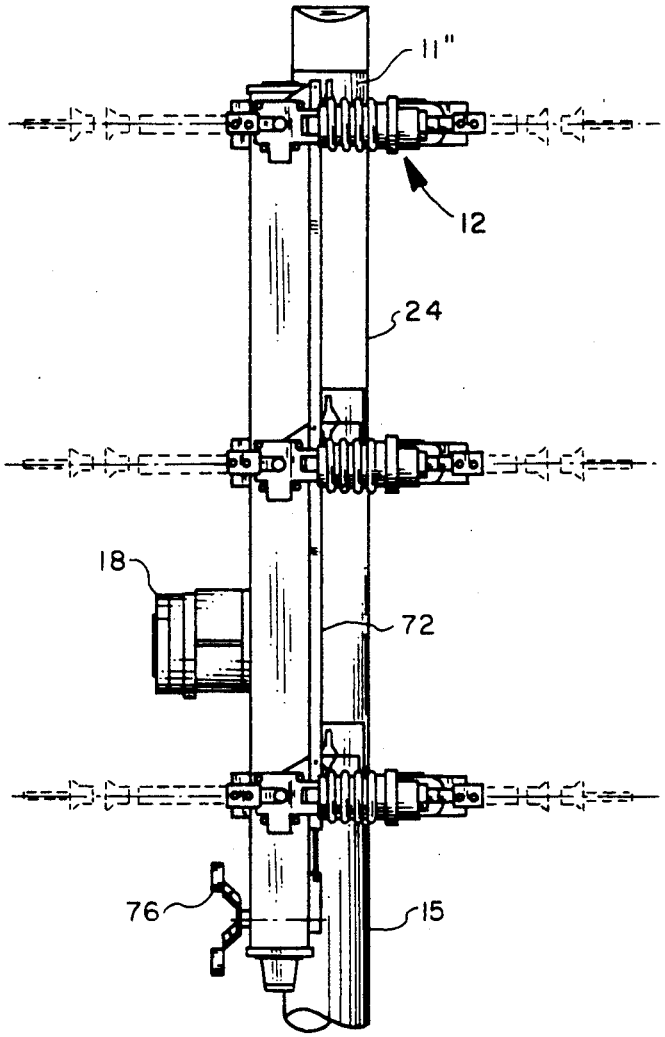
Figure 12:
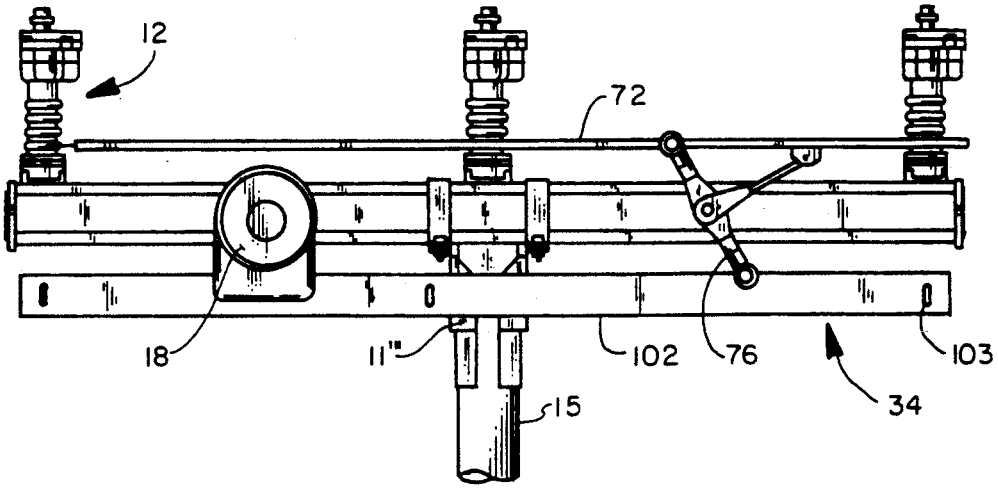

Considering now additional aspects of the present invention and referring additionally to FIGS. 9–12, the components and layout of the switch provides a variety of mounting configurations that are each adapted for efficient incorporation into specific distribution circuits; i.e., the switch is matched to line designs, patterns, and layouts. For example, the switch of FIG. 9 illustrates an upright mounting configuration that is adapted to common line designs with phase wires being at appropriate phase spacings in a horizontal plane (side-by-side). The vertical mounting configuration of FIG. 10 is especially suited for switching cable drops from an overhead line. In FIG. 11, the tiered-outboard configuration is useful to match the phase-over-phase line design. A compact pole-top configuration is illustrated in FIG. 12, which is specifically adapted for mounting at the top of a pole. It should be noted that the switch including the switch-pole units, high-speed base, disconnect linkage, disconnect operating handle, operating mechanism, and dead-ending provisions all cooperate and interact in the various configurations to provide a switch arrangement that is compact and uncluttered, while also being desirable for line layouts and providing easy access for operation and maintenance. In the tiered-outboard configuration of FIG. 11, for ease of operation, the disconnect handle 76 is located at the lower end of the tubular support member 24. As can be seen, the disconnect handle 76 and the operating mechanism 18 are conveniently located and may be easily moved along the switch for desirable operation and mounting considerations with respect to the line layout and the pole due to the basic switch layout and integral components. Note that the disconnect linkage permits the plane of the manual disconnect handle 74 to be changed in the upright mounting configuration compared to the vertical mounting configuration.

Referring now again to FIG. 7, in a preferred embodiment, the support base 22 of the switch-pole units (e.g., 12,14,16) includes a rectangular cross-sectioned tubular support arm 166 so as to define the duct or conduit 54 for routing of the signal conductors, e.g, 52*a*,52*b*. The tubular support arm 166 is closed at the end supporting the insulator 46 by an end cap 167 which also extends around the bottom of the tubular support arm 166 to cover an access hole 169 that provides access to the bottom of the insulator 46 for assembly, etc. The tubular support arm 166 at the other end thereof is affixed over an extending arm portion 171 of a bearing housing 168 in telescoping fashion and is retained by a threaded fastener 170. The arm portion 171 defines a central duct or passage 172 that communicates between the interior 54 of the tubular support arm 166 and the interior of the bearing housing 168. The bearing housing 168 is affixed to the tubular support member 24 and extends into the tubular support member 24 via a hole 178. A hole 174 in the bottom wall of the bearing housing 168 provides passage of the signal conductors 52*a*,52*b* into the tubular support member 24 for appropriate routing, for example, via guide hangers 175 of FIG. 7 or via a conduit 57 as illustrated in FIG. 1. Thus, the signal conductors 52*a*,52*b* extend through the switch-pole units (e.g., 12,14,16) and into and along the tubular support member 24 for routing and connection, as discussed hereinbefore and as shown in FIG. 1.

While there have been illustrated and described various embodiments of the present invention, it will be apparent that various changes and modifications will occur to those skilled in the art. Accordingly, it is intended in the appended claims to cover all such changes and modifications as fall within the true spirit and scope of the present invention.

What is claimed and desired to be secured by Letters Patent of the United States is:

1. A switch providing an interrupting function and a selective disconnect function between first and second circuit terminals comprising:

a plurality of switch-pole units, each of said switch-pole units including support means, a housing, means for movably supporting said housing with respect to said support means, interrupting means including separable interrupting contacts and means for operating said interrupting contacts via a first drive input, and disconnect switch contacts, said interrupting means being disposed in and supported by said housing, said disconnect switch contacts and said separable interrupting contacts being connected in series between the first and second circuit terminals, a first of said disconnect contacts being disposed externally to and carried by said housing, said housing being movable via a second drive input and with respect to said first drive input as a movable switching member to perform said disconnect function via separation of said disconnect switch contacts;

base support and drive means for operating said interrupting means and supporting said plurality of switch-pole units, said base support and drive means including a high-speed base drive linkage that is enclosed by said base support and drive means, said base drive linkage being connected to each of said respective first drive inputs to said switch-pole units; and disconnect-switch operating means being supported with respect to said base support and drive means and being connected to said second drive input of said switch-pole units for performing said disconnect function via movement of said housing, said disconnect-switch operating means including a disconnect linkage and an operating arm for actuation of said disconnect linkage.

2. The switch of claim 1 wherein said base support and drive means further comprises operating mechanism means that is supported by said base support and drive means, said operating mechanism means including a drive output that is connected to said high-speed base drive linkage.

3. The switch of claim 2 wherein said base support and drive means includes a tubular support member and a first predetermined opening through which said drive output is disposed.

4. The switch of claim 3 wherein one or more of said plurality of switch-pole units includes means integrally incorporated within said switch-pole unit for deriving electrical energy signals corresponding to one or more circuit parameters.

5. The switch of claim 4 wherein each of said one or more switch-pole units includes a switch-pole unit base that is supported by said tubular support member.

6. The switch of claim 5 further comprising means for communicating said derived electrical energy signals from said sensing means to a predetermined point internal to said tubular support member.

7. The switch of claim 6 wherein said communicating means includes one or more signal conductors, said switch-pole unit base including conduit-defining means for providing a path internal to said switch-pole unit and extending external to a predetermined portion of said switch-pole unit base.

8. The switch of claim 7 wherein said tubular support member includes a second predetermined opening for receiving said predetermined portion of said switch-pole unit base internal to said tubular support member.

9. The switch of claim 8 wherein said one or more signal conductors extend from said sensing means through said switch-pole unit base and internally to said tubular support member.

10. The switch of claim 9 wherein said sensing means includes means for supplying operating power to said operator mechanism.

11. The switch of claim 3 wherein said operating mechanism includes a housing which covers said first predetermined opening.

12. The switch of claim 11 wherein said tubular support member along its length includes a generally open side wall having opposed inwardly turned edges so as to form opposed flanges, said base support and drive means further including first means for generally closing said open side wall and defining said predetermined opening.

13. The switch of claim 11 wherein said first means comprises one or more generally planar panels that are inserted into said tubular support member.

14. The switch of claim 13 wherein said first means further comprises guiding and spacing means affixed internal to said tubular member and facing said open side wall for defining guiding and receiving channels.

15. The switch of claim 14 wherein said guiding and spacing means comprises members spanning said opposed flanges.

16. The switch of claim 14 wherein said one or more generally planar panels include opposed longitudinally defined flanges adapted to interfit with said guiding and spacing means.

17. The switch of claim 1 wherein said high-speed base drive linkage and said disconnect linkage are generally parallel to each other.

18. The switch of claim 1 wherein said operating arm of said disconnect-switch operating means is movably supported with respect to said base support and drive means at a predetermined location.

19. The switch of claim 18 wherein said predetermined location is a first location for a first mounting configuration of said switch and a second location for a second mounting configuration for said switch.

20. The switch of claim 19 wherein said predetermined location is a third location for a third mounting configuration of said switch.

21. The switch of claim 1 wherein said switch-pole unit includes means for supporting the first circuit terminal and said second of said disconnect-switch contacts, said first of said disconnect-switch contacts being connected to a first of said separable interrupting contacts, a second of said separable interrupting contacts being connected to the second circuit terminal, the second circuit terminal being defined at and carried by said housing, said separable interrupting contacts being disposed within a portion of said housing that is moved to perform the disconnect function.

22. The switch of claim 21 wherein said supporting means includes means for sensing one or more circuit parameters present at the first circuit terminal.

23. The switch of claim 22 wherein said sensing means are integrally incorporated within said supporting means.

24. The switch of claim 1 wherein said housing is rotatable with respect to said switch-pole unit via said second drive input.

25. The switch of claim 24 wherein said interrupter operating means comprises an operating member extending within and external to said housing.

26. The switch of claim 25 wherein rotation of said operating member operates said separable interrupting contacts.

27. The switch of claim 26 wherein said housing includes a first portion and a second portion extending in a predetermined direction to said first portion.

28. The switch of claim 27 wherein said separable interrupting contacts are disposed within said second portion of said housing, said operating member extending through said first portion.

29. The switch of claim 28 wherein said housing is rotated about an axis through said first portion.

30. The switch of claim 29 wherein said operating member is disposed parallel to said axis.

31. The switch of claim 30 wherein said operating member is centrally disposed through said first portion.

32. The switch of claim 1 further comprising means for supporting said base support and drive means, and dead-ending means supported by said supporting means for providing dead-ending attachment provisions adjacent each of said plurality of switch-pole units.

33. The switch of claim 32 wherein said base support and drive means comprises a first support member and said dead-ending means comprises a second support member, said first and second support members being disposed generally parallel to each other.

34. The switch of claim 33 wherein said supporting means comprises a mounting bracket including means for mounting to an equipment pole.

35. The switch of claim 33 wherein said dead-ending means further comprises a plurality of attachment means, each of said attachment means being carried by said second support member.

36. The switch of claim 35 wherein said attachment means comprises two or more components that are assembled about said second support member.

37. The switch of claim 36 wherein said second support member includes apertures therethrough at predetermined locations with respect to said position of said switch-pole units, said two or more components being assembled about said second support member and passing through said apertures.

38. The switch of claim 37 wherein one or more of said two or more components includes an attachment provision adapted for receiving predetermined elements.

39. The switch of claim 38 wherein said attachment provision comprises a ring.

40. A switch configuration comprising:

a plurality of switch-pole units, each of said plurality of switch-pole units comprising interrupting and disconnecting means for interrupting current in a path between two circuit terminals and for selectively thereafter providing a disconnect function via movement away from a first of the two circuit terminals, each of said switch-pole units including a housing having a first housing portion and a second housing portion extending in a predetermined direction from said first housing portion, each of said switch-pole units further including means for rotatably supporting said housing about a predetermined axis through said first housing portion, said interrupting and disconnecting means including separable interrupting contacts disposed in said second housing portion and an operating member disposed through said first housing portion and generally along said predetermined axis, said operating member being rotatable with respect to said housing;

a support base for supporting said plurality of switch-pole units, each of said switch-pole units being affixed to said support base at predetermined pole spacing dimensions therebetween, said support base comprising a tubular member;

drive means enclosed within said tubular member and including a drive connection to each said operating member to operate said respective separable interrupting contacts via movement of said operating members, and disconnect operating means for rotating said housing of each of said plurality of switch-pole units, said disconnect operating means including an operating handle supported by and movable with respect to said support base.

41. A distribution switch comprising:

a mounting bracket adapted for affixing to an equipment pole;

a first support member supported by said mounting bracket;

a plurality of switch-pole units supported by said first support member and disposed at predetermined locations;

a second support member disposed generally parallel to said first support member and being supported by said mounting bracket; and dead-ending means for supporting an attached load and being carried by said second support member and disposed at predetermined locations with respect to said plurality of switch-pole units.

42. The switch of claim 41 wherein said dead-ending means comprises two components that are assembled about said second support member.

43. The switch of claim 42 wherein said second support member includes apertures therethrough at predetermined locations with respect to said position of said switch-pole units, said at least two components being assembled about said second support member and passing through said apertures.

44. The switch of claim 43 wherein one or more of said at least two components includes an attachment provision adapted for receiving predetermined elements.

45. The switch of claim 44 wherein said attachment provision comprises a ring.

46. In a distribution switch having a drive linkage disposed within a tubular support member for operating a plurality of switch-pole units, operating mechanism means supported by said tubular support member so as to be external to said tubular support member for imparting movement to said drive linkage, said operator mechanism means including a housing and drive output means extending from said housing and affixed to said drive linkage, said tubular support member comprising means for defining a predetermined opening said drive output means extending into said tubular support member via said predetermined opening, said housing covering said predetermined opening.

47. The combination of claim 46 wherein said operator mechanism means comprises means for removably mounting said operator mechanism means with respect to said tubular support member and said drive linkage.

48. The combination of claim 47 wherein said removable mounting means comprises a connecting link removably connected between said drive output means and said drive linkage.

49. The combination of claim 48 wherein said predetermined opening defining means comprises a face panel and said tubular support member having an open side wall and opposed inwardly defined flanges, said face panel being inserted into said tubular support member to close a portion of said side wall so as to define said predetermined opening.

50. A method of providing one of a plurality of different switch configurations by selectively arranging and assembling a plurality of components including base drive and support means, a plurality of switch-pole units disposed at predetermined locations along said base drive and support means, an operating mechanism carried by said base drive and support means at a predetermined location and having a drive output, a disconnect linkage connected to said plurality of switch-pole units, and a manual operating handle movably supported at a predetermined location of said base drive and support means and connected to said disconnect linkage, said base drive and support means including an internally disposed high-speed drive train connected to said plurality of switch-pole units, the method comprising the steps of:

disposing said plurality of switch-pole units along said base drive and support means in a first predetermined pattern for a first upright switch configuration with said manual operating handle being supported in a first position on a first plane of said base support and drive means;

disposing said plurality of switch-pole units along said base drive and support means in said first predetermined pattern for a second vertical switch configuration with said manual operating handle being supported in a second position on a second plane of said base support and drive means;

disposing said plurality of switch-pole units along said base drive and support means in a second predetermined pattern in a third tiered-outboard configuration with said manual operating handle being supported in a third position on said first plane of said base support and drive means; and disposing said plurality of switch-pole units along said base drive and support means in said second predetermined pattern for a fourth pole-top switch configuration with said manual operating handle being supported on said first plane of said base support and drive means.

51. The method of claim 50 further comprising a mounting bracket, for said first upright switch configuration said base drive and support means being affixed to said mounting bracket between two of said plurality of switch-pole units and between said manual operating handle and one of said plurality of switch-pole units.

* * * * *

UNITED STATES PATENT AND TRADEMARK OFFICE

CERTIFICATE OF CORRECTION

PATENT NO. : 5,091,616

DATED : Feb. 25, 1992

INVENTOR(S) : Joel A. Ramos, et al

It is certified that error appears in the above-identified patent and that said Letters Patent is hereby corrected as shown below:

Col. 4, line 56, "ploe" should be -- pole --;

Col. 5, line 31, "07/331/570" should be -- 07/331,570 --;

Col. 7, line 3, after "device" insert -- , -- (comma);

Col. 15, line 27, claim 42, after "comprises" insert -- at least --;

Col. 15, line 51, claim 46, after "opening" insert -- , -- (comma).

Signed and Sealed this

Third Day of August, 1993

Michael K. Kirk

*Attest:*

MICHAEL K. KIRK

*Attesting Officer*

*Acting Commissioner of Patents and Trademarks*